US005957153A

United States Patent [19]

Frey et al.

[11] Patent Number: 5,957,153

[45] Date of Patent: Sep. 28, 1999

[54] OSCILLATING DUAL BLADDER BALANCED PRESSURE PROPORTIONING PUMP SYSTEM

[75] Inventors: Max Frey, Portland; Marc A. Frey, Tigard, both of Oreg.

[73] Assignee: Frey Turbodynamics, Ltd., Portland, Oreg.

[21] Appl. No.: 09/156,341

[22] Filed: Sep. 18, 1998

[51] Int. Cl.[6] ..... E03B 7/00

[52] U.S. Cl. ..... 137/240; 137/564.5

[58] Field of Search ..... 137/101.11, 240, 137/205.5, 564.5

[56] References Cited

U.S. PATENT DOCUMENTS

| | | | |
|---|---|---|---|
| 121,678 | 12/1871 | Snyder | 417/473 |
| 2,611,439 | 9/1952 | Faulkner | 137/101.11 X |
| 2,865,388 | 12/1958 | Sternbergh | 137/564.5 |
| 2,960,999 | 11/1960 | Lazy, Jr. | 137/564.5 |
| 3,040,774 | 6/1962 | Stenberg | 137/564.5 |
| 3,166,096 | 1/1965 | Lang | 137/564.5 |
| 3,200,840 | 8/1965 | Watts | 137/564.5 |
| 3,250,226 | 5/1966 | Voelker | 417/339 |
| 3,496,879 | 2/1970 | Brandes | 417/46 |
| 3,749,526 | 7/1973 | Ferrentino | 417/390 |
| 4,005,803 | 2/1977 | Kent | 222/57 |
| 4,037,618 | 7/1977 | Kresser et al. | 137/564.5 X |
| 4,090,818 | 5/1978 | Hope et al. | 417/473 |
| 4,234,044 | 11/1980 | Hollan et al. | 169/14 |
| 4,324,294 | 4/1982 | McLoughlin et al. | 169/13 |
| 4,381,180 | 4/1983 | Sell | 417/393 |
| 4,392,791 | 7/1983 | Mandroian | 417/379 |
| 4,449,543 | 5/1984 | Greene, Jr. | 137/564.5 X |
| 4,548,551 | 10/1985 | Ruttenberg et al. | 417/393 |
| 4,718,893 | 1/1988 | Dorman et al. | 604/67 |
| 4,736,769 | 4/1988 | Belanger | 137/564.5 |
| 4,755,111 | 7/1988 | Cocchi et al. | 417/394 |
| 4,887,646 | 12/1989 | Down | 137/564.5 |
| 4,915,599 | 4/1990 | Katsuyama et al. | 417/393 |
| 4,966,528 | 10/1990 | Henkel et al. | 417/63 |
| 5,009,244 | 4/1991 | Grindley et al. | 137/101.11 |
| 5,205,722 | 4/1993 | Hammond | 417/395 |
| 5,209,298 | 5/1993 | Ayres | 166/305.1 |
| 5,209,299 | 5/1993 | Ayres | 166/305.1 |
| 5,209,300 | 5/1993 | Ayres | 166/305.1 |
| 5,209,301 | 5/1993 | Ayres | 166/305.1 |
| 5,261,798 | 11/1993 | Budde | 417/393 |
| 5,277,555 | 1/1994 | Robinson | 417/393 |
| 5,332,372 | 7/1994 | Reynolds | 417/393 |
| 5,335,734 | 8/1994 | Scott et al. | 169/15 |
| 5,398,765 | 3/1995 | Worthington | 169/52 |
| 5,494,112 | 2/1996 | Arvidson et al. | 169/13 |
| 5,573,385 | 11/1996 | Chevallier | 417/393 |

FOREIGN PATENT DOCUMENTS

| | | | |
|---|---|---|---|
| 539548 | 7/1955 | Belgium | 137/564.5 |

*Primary Examiner*—John Rivell

*Attorney, Agent, or Firm*—Kolisch, Hartwell, Dickinson, McCormack & Heuser

[57] ABSTRACT

A proportioning pumping system that injects an injection fluid into a pressurized conduit flowing with a working fluid at a constant proportion of injection fluid to working fluid regardless of changes in flow rate or pressure within the working fluid conduit. Injection fluid is pumped continuously, by the working fluid, from a non-pressurized tank. The system includes two or more vessels, each divided into two chambers by a diaphragm or bladder. Valving and passages simultaneously fill one vessel with working fluid and pump injection fluid while filling the other vessel with injection fluid and draining working fluid. A first pressure differential creating device in the working fluid conduit draws injection fluid into the working fluid conduit. A second pressure differential creating device determines the proportion of working fluid and injection fluid to be combined.

37 Claims, 9 Drawing Sheets

OSCILLATING DUAL BLADDER BALANCED PRESSURE PROPORTIONING PUMP SYSTEM

FIELD OF THE INVENTION

The present invention relates to a pump that proportionately delivers one fluid, from an open or closed tank, continuously into a conduit flowing with a second fluid, at a constant proportion by volume of first fluid to second fluid regardless of changes in pressure or flow rate within the conduit.

BACKGROUND OF THE INVENTION

The accurate proportioning of chemicals into pressurized flowing conduits is required in many applications. In agriculture, additives such as pesticides, herbicides and fertilizers are directly injected at various proportions into crop irrigation systems. Flow rates and pressures may continually change in the pipelines as sprinklers are turned on or off, or as elevations and pumping conditions change. Providing large amounts of power to drive an injection pump at remote sites may be difficult as well. In firefighting applications, a foam concentrate is injected into fire hoses at specific proportions so that proper foaming from the fire nozzles is achieved. Flow rates and pressures in the water lines are continually changing as firefighters adjust nozzles, add more hoses, increase fire pump pressure, etc.

One method of proportioning fluids into pressurized pipelines is exemplified by the U.S. Pat. No. 5,494,112 to Arvidson et al. This system injects firefighting foam concentrate into water streams that are intended to put out fires. A positive displacement pump at a given speed delivers a fixed volume of foam concentrate. The flow rate in the conduit into which the foam concentrate is to be injected is measured by a flowmeter which is inserted into the flowing conduit. This signal is then electronically manipulated and used to adjust the speed of the positive displacement pump to deliver the proper proportion of injected fluid to conduit fluid (water). Problems with these types of systems include damage to the flowmeter by debris flowing in the conduit, and inability to compensate for large changes in the pressure within the conduit. In addition, for high flow rates of the proportioned fluid, significant power is required to drive the positive displacement pump, which creates a substantial power draw on the fire truck electrical system.

Diaphragm pumps have been used for pumping fluids. For example, U.S. Pat. No. 3,250,226 to Voelker and U.S. Pat. No. 3,749,526 to Ferrentino disclose the concept of two hydraulically connected diaphragm chambers which are pressurized and depressurized to provide continuous pumping action. However, these systems are not capable of proportioning fluids into systems flowing with a second fluid where flow rates and/or pressures are varying in the second fluid.

U.S. Pat. No. 5,009,244 to Grindley et al. illustrates an example of a system that includes a vessel with a diaphragm for proportioning. The device disclosed in that patent provides proportioning of one fluid into another fluid and is not affected by pressure changes. However, because it has only one diaphragm vessel, the device must be stopped to be refilled with the fluid to be injected, and thus is not able to automatically and continuously proportion fluid. For systems which require large flow rates of the proportioned fluid, the device must be stopped fiequently or a very large vessel must be provided. Because large pressure vessels can be bulky, heavy and expensive and may require ASME coding, such systems are impractical for situations requiring large flow rates or proportioning for an extended period of time.

SUMMARY OF THE INVENTION

The present invention overcomes these problems by providing an apparatus for continuously and proportionately injecting an injection fluid into a pressurized conduit flowing with a working fluid. The apparatus includes a first vessel enclosing a first flexible element that divides the first vessel between a first injection fluid chamber and a first working fluid chamber, and a second vessel enclosing a second flexible element that divides the second vessel between a second injection fluid chamber and a second working fluid chamber. A first pressure differential creating device is contained within the pressurized conduit and creates therein a first reduced pressure region. A first conduit network selectively connects the pressurized conduit to the first and second working fluid chambers, and a second conduit network selectively connects the first and second injection fluid chambers to the first reduced pressure region in the pressurized conduit. A control system controls the filling and emptying of the first and second injection fluid chambers and the first and second working fluid chambers, to ensure a continuous flow of injection fluid into the first reduced pressure region at a predetermined proportion that is independent of working fluid flow rate and pressure. The apparatus may also include a second pressure differential creating device, disposed within the second conduit network, that creates a second reduced pressure region within the second conduit network.

In another aspect of the present invention, an apparatus is provided that continuously and proportionately injects an injection fluid into a pressurized conduit flowing with a working fluid. The apparatus includes a first pressure differential creating device disposed in and forming part of the pressurized conduit and creating therein a first pressure region and a second pressure region having a lower pressure than the first pressure region, and a second pressure differential creating device creating a first pressure region and a second pressure region having a lower pressure than the first pressure region of the second pressure differential creating device. A first vessel encloses a first flexible element that divides the first vessel between a first injection fluid chamber and a first working fluid chamber, and a second vessel encloses a second flexible element that divides the second vessel between a first injection fluid chamber and a second working fluid chamber. The first and second injection fluid chambers are selectively connected to the second pressure region of the pressurized conduit and are selectively filled with and emptied of the injection fluid, and the first and second working fluid chambers are selectively filled with and emptied of the working fluid. The injection fluid is thereby combined at a predetermined proportion with the working fluid at the low pressure region of the pressurized conduit independent of the working fluid flow rate and pressure.

In another aspect of the present invention, a method of combining an injection fluid into a working fluid is provided. The method includes the steps of: providing first and second vessels, each vessel divided by a flexible element into a working fluid chamber and an injection fluid chamber; selectively and alternately filling the injection fluid chambers of the first and second vessels with working fluid; directing a first part of the working fluid to flow through a first pressure differential creating device; directing a second part of the working fluid to selectively and alternately flow through a second pressure differential creating device and into and out of the working fluid chambers of the second and first vessels; and selectively and alternately emptying the injection fluid contained in the injection fluid chambers into a low-pressure region created by the first pressure differential creating device, whereby the alternate filling and emptying of the working and fluid chambers of the first and second vessels provides a constant proportioning of injection fluid into working fluid, the proportioning being independent of working fluid pressure and flow rate.

The control system achieves continuous pumping action by controlling the flow of injection fluid and working fluid so that one vessel is receiving pressurized working fluid into its working fluid chamber and pushing out injection fluid from its injection fluid chamber while the other vessel is being drained of working fluid from its working fluid chamber and is filling with injection fluid in its injection fluid chamber. Injection fluid is thereby drawn directly from an open tank without the need for providing a large pressurized vessel. This provides for the most compact design. In addition, the flexible elements provide a 100% efficient transfer of pressure from the working fluid to the injection fluid.

The pressurization of the two vessels is done with the working fluid in the conduit, thus eliminating the need for a source of power to drive the proportioning pump. This system is self-contained and could be used at remote locations where power is not available. It also provides for a completely sealed system.

By locating the proper pressure differential creating device in the conduit which is flowing with the working fluid and connecting the inlet to the bladder or diaphragm vessel system to the upstream or higher pressure point in the pressure differential creating device and connecting the outlet of the bladder or diaphragm vessel system to the downstream or low pressure point of the differential creating device, a proportioning pump is created where the flow rate of injected fluid being pumped out of the bladder or diaphragm vessels and into the conduit is directly proportional to the flow rate of process fluid flowing through the conduit. Proportioning is also unaffected by changes in pressure within the conduit (balanced pressure). The differential creating device can be an orifice, venturi, valve, etc., which are devices not easily damaged by debris in the conduit.

DETAILED DESCRIPTION OF THE PREFERRED EMBODIMENTS

Figure 1:
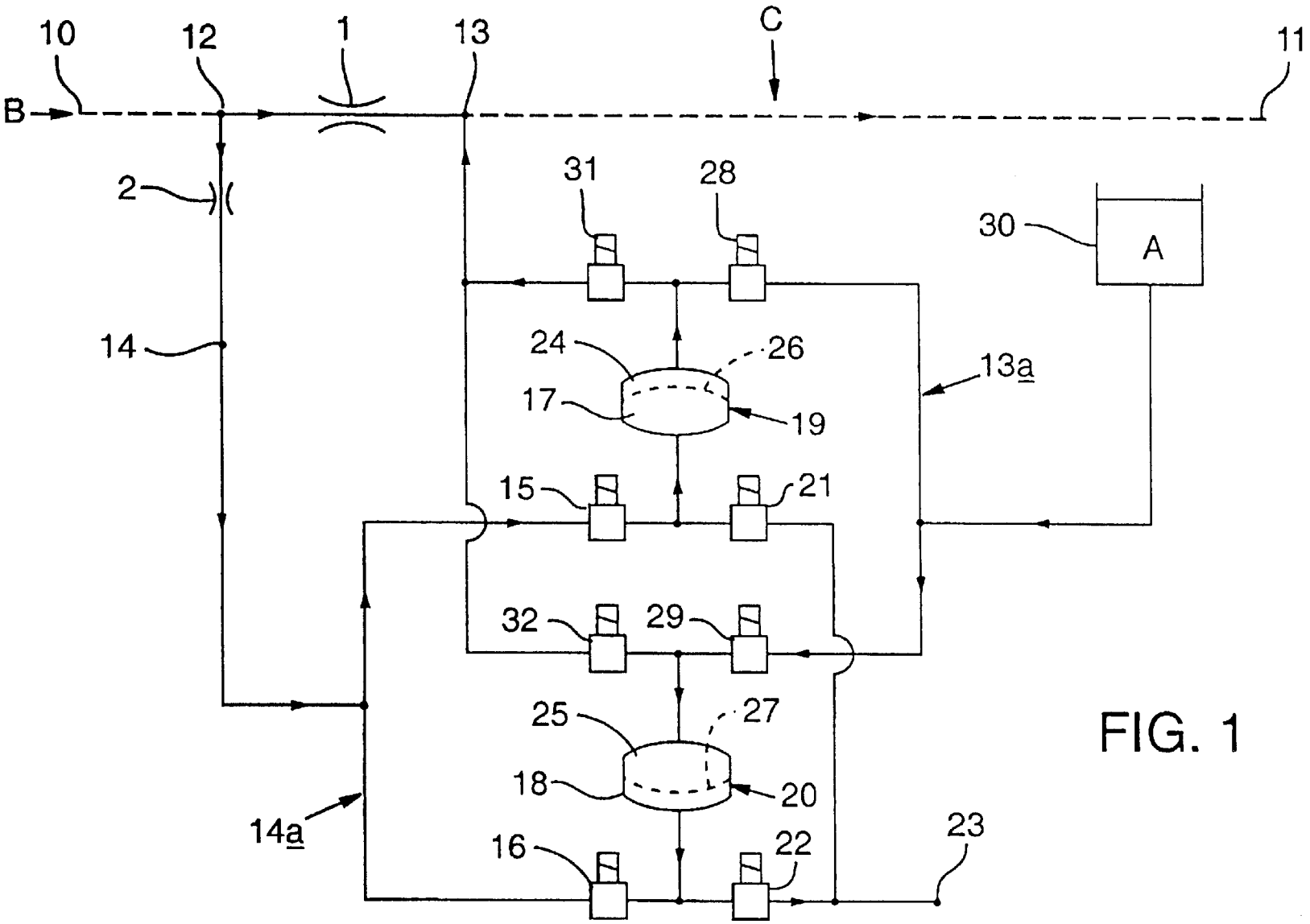
FIG. 1 is a schematic diagram showing the hydraulic arrangement of a preferred embodiment of the present invention.

FIG. 1 shows a schematic of a preferred embodiment of the present invention. A first fluid, which is a working fluid B, flows between inlet 10 and outlet 11 in a pressurized conduit C. Working fluid B flows through a first pressure differential creating device 1, which is disposed between inlet 10 and outlet 11. A pressure drop occurs from device 1's inlet 12 to its outlet or low pressure area 13. This pressure drop is a function of the flow rate only and is not influenced by the ambient pressure within conduit C.

At point 12 a line is branched with outlet 14. Between inlet 12 and outlet 14 there is a second pressure differential creating device 2. As with first device 1, a pressure drop occurs from second device 2's inlet 12 to its outlet 14, the pressure drop being a function only of flow rate through second device 2.

First and second vessels 19 and 20, respectively, are provided, each vessel having a first chamber 17, 18, respectively, and a second chamber 24, 25, respectively. First chambers 17, 18 and second chambers 24, 25 are respectively separated from one another by a diaphragm or bladder 26, 27. These diaphragms are designed to move freely within the confines of the vessels and do not stretch or otherwise internally store energy.

Outlet 14 is connected, to the inlets of a first pair of externally actuated working fluid inlet valves 15 and 16. Valves 15, 16 admit working fluid B into chambers 17 and 18 in first and second vessels 19 and 20, respectively. First and second externally actuated working fluid outlet valves 21 and 22 are also connected to chambers 17 and 18 and their outlets are connected to a drain 23 to cany working fluid B out of chambers 17 and 18. The connections between inlet 12 and drain 23 form a first conduit network 14*a*.

Chambers 24 and 25 in vessels 19 and 20 are connected to the outlets of first and second externally actuated injection fluid inlet valves 28 and 29, respectively. These valves admit a second fluid, which is an injection fluid A, from tank 30 into chambers 24 and 25. Chambers 24 and 25 are also connected to the inlets of externally actuated injection fluid outlet valves 31 and 32. The outlets of valves 31 and 32 are connected to the low pressure area or outlet 13 of first pressure differential creating device 1. The connections between tank 30 to outlet 13 form a second conduit network 13*a*.

Externally actuated valves 15, 16, 21, 22, 28, 29, 31 and 32 are opened and closed in a specific sequence to produce pumping action in a delivery cycle, as will be described in the following paragraphs.

In the first half of the delivery cycle, as depicted in FIG. 1, valves 15 and 31 are open and valves 21 and 28 are closed. The pressure differential between points 12 and 13 causes working fluid B to flow through second device 2, through valve 15 and into chamber 17 of first vessel 19. Diaphragm 26 displaces a volume of injection fluid A from chamber 24 which is equal to the amount of working fluid B coming into chamber 17. Injection fluid A flows through valve 31 and is delivered into conduit C at point 13, which is the low pressure area of first device 1. A mixture of injection fluid A and working fluid B exits conduit C at outlet 11.

At the same time injection fluid A contained in first vessel 19 is being delivered into the conduit at point 13, chamber 25 of second vessel 20 is filling with injection fluid A. Referring to FIG. 1, valves 16 and 32 are closed and valves 22 and 29 are open. Any working fluid B contained in chamber 18 of second vessel 20 is drained away through valve 22 and drain 23. This allows room for injection fluid A to flow from tank 30, through valve 29, and into chamber 25 of second vessel 20.

In the second half of the delivery cycle, which typically will begin after chamber 25 is completely filled, valves 15, 31, 22 and 29 are closed and valves 16, 32, 21 and 28 are opened. Working fluid B drains out of chamber 17 in first vessel 19 and through valve 21 and drain 23 while injection fluid A from tank 30 fills chamber 24 through valve 28. Chamber 18 in second vessel 20 simultaneously receives working fluid B through valve 16, thereby pushing injection fluid A out of chamber 25, through valve 32 and into conduit C at point 13. A mixture of injection fluid and working fluid exits conduit C at outlet 11. This cycle of filling one vessel with injection fluid A while the other vessel pushes the injection fluid into conduit C is repeated to produce a continuous flow of injection fluid into the conduit.

In designing the system of the present invention, it is desirable for the pressure at point 14 be equal to the pressure at point 13 at all flow rates. To this end, the flow passageways and valves between points 14 and 13 should be designed and selected so that the pressure losses due to flow friction are negligibly small compared to the pressure drop created by the pressure differential device 2. However, if designing and selecting passageways and valves which lie between points 14 and 13 for minimum pressure loss is not practical, the system can be calibrated to compensate for the pressure drop from 14 to 13 due to the friction loss in the passageways and valves. This pressure drop can be easily calculated and compensated for because it is also a function of the flow rate between points 14 and 13.

For turbulent flow, the flow rate as a function of pressure drop for the two pressure differential creating devices 1 and 2 is given by the equation $$Q/K=\sqrt{P_D}$$

where Q is the flow rate through the device, K is a flow constant defined by the geometry of the device, and PD is the pressure differential across the device.

For turbulent flow, the following equations apply:

$$Q1/K1=\sqrt{P(12)-P(13)}$$

$$Q2/K2=\sqrt{P(12)-P(14)}$$

where

Q1=Flow rate through device 1
K1=Flow coefficient for device 1
Q2=Flow rate through device 2
K2=Flow coefficient for device 2
P(12)=Pressure at point 12
P(13)=Pressure at point 13
P(14)=Pressure at point 14

Since the pressures at points 13 and 14 are either designed or calibrated to be equal (P(13)=P(14)), $$\sqrt{P(12)-P(13)}=\sqrt{P(12)-P(14)}.$$

Therefore, $$Q1/K1=Q2/K2$$

and $$Q2/Q1=K2/K1=\text{constant}.$$

For laminar flow, the flow rate as a function of pressure drop for the two pressure differential creating devices 1 and 2 is given by the equation $$Q/K=P_D$$

and the following equations apply:

$$Q1/K1=P(12)-P(13)$$

$$Q2/K2=P(12)-P(14).$$

Since P(13)=P(14), $$P(12)-P(13)=P(12)-P(14).$$

Therefore, $$Q1/K1=Q2/K2$$

and $$Q2/Q1=K2/K1=\text{constant}.$$

Thus, regardless of whether the flow through first and second pressure differential creating devices 1, 2 is laminar or turbulent, the rate of flow of working fluid B through first differential creating device 1 is proportional to the rate of flow of working fluid B through second pressure differential creating device 2.

Furthermore, the rate of injection fluid A flowing from the chambers 24 or 25 of vessels 19 or 20 is the same as the rate of working fluid B flowing into chambers 17 or 18 of vessels 19 or 20 since there is substantially no internal storage of energy within the diaphragms 26, 27. The rate of injection fluid A being injected into conduit C is therefore also proportional to the rate of working fluid B flowing through the conduit between points 12 and 13.

By selecting the proper pressure drops and flow losses in the circuit to fill chambers 24, 25 with injection fluid A and the proper cycle times for valve opening and closing, the system can be designed to completely fill one of the chambers with injection fluid A before the other of the chambers has pumped out all of its injection fluid. This assures that chambers 24, 25 are full prior to respectively delivering injection fluid A into conduit C. Thus the maximum capacity of each vessel can be utilized.

Figure 2:
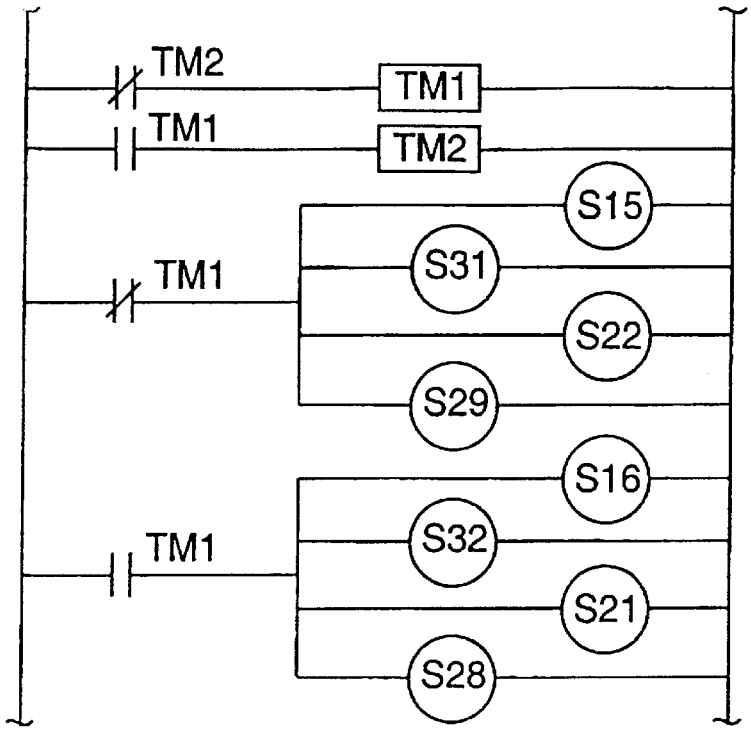
FIG. 2 is a schematic diagram of an electric circuit usable with the embodiment depicted in FIG. 1.

To provide continuous pumping action, valves 15, 31, 21, 28, 16, 32, 22 and 29 must be opened and closed in a certain sequence. Valves 15 and 31 and valves 22 and 29 are opened while valves 21 and 28 and 16 and 32 are closed during the first half of a delivery cycle. During the second half of the delivery cycle, valves 15 and 31 and 22 and 29 are closed while valves 21 and 28 and 16 and 32 are open. FIG. 2 shows an electric timing circuit schematic for cycling the valves. S15 represents a solenoid that controls actuation of valve 15. S31 is a solenoid that controls actuation of valve 31, etc. TM1 and TM2 are timers which, when energized, will delay closing their respective contacts for a fixed time. Referring to FIG. 2, upon power being applied to the circuit, TM1 is energized and solenoids S15, S31, S22 and S29 are energized. When TM1 closes its contacts after a first fixed time, S15, S31, S22 and S29 are de-energized and S16, S32, S21, S28 and TM2 are energized. When TM2 closes its contacts after a second fixed time, TM1 is de-energized. The circuit is reset and the cycle starts over again.

During the time that the valves are switching between cycle halves, there is a period over which flow is momentarily interrupted. Although this interruption is very short in duration, in some proportioning applications it may not be desirable.

To overcome this interruption, a preferred embodiment of the control circuit design provides an overlapping timing cycle. Table 1 shows a valve actuation schedule in which first and second cycle halves are designated a "I" and "II" respectively, and an intermediate stage, through which the system passes each time it shifts between cycle halves, is designated "IA". Open and closed valves are represented by "O" and "XX", respectively. Also shown are the states of chambers 17, 18, 24, 25, in which "F" represents a state where fluid is flowing into the chamber and "D" represents a state where fluid is flowing out of the chamber.

TABLE 1

| | I | IA | II |
|---|---|---|---|
| 15 | O | O | X |
| 16 | X | O | O |
| 21 | X | X | O |
| 22 | O | X | X |
| 28 | X | X | O |
| 29 | O | X | X |
| 31 | O | O | X |
| 32 | X | O | O |
| 17 | F | F | D |
| 18 | D | F | F |
| 24 | D | D | F |
| 25 | F | D | D |

Figure 3:
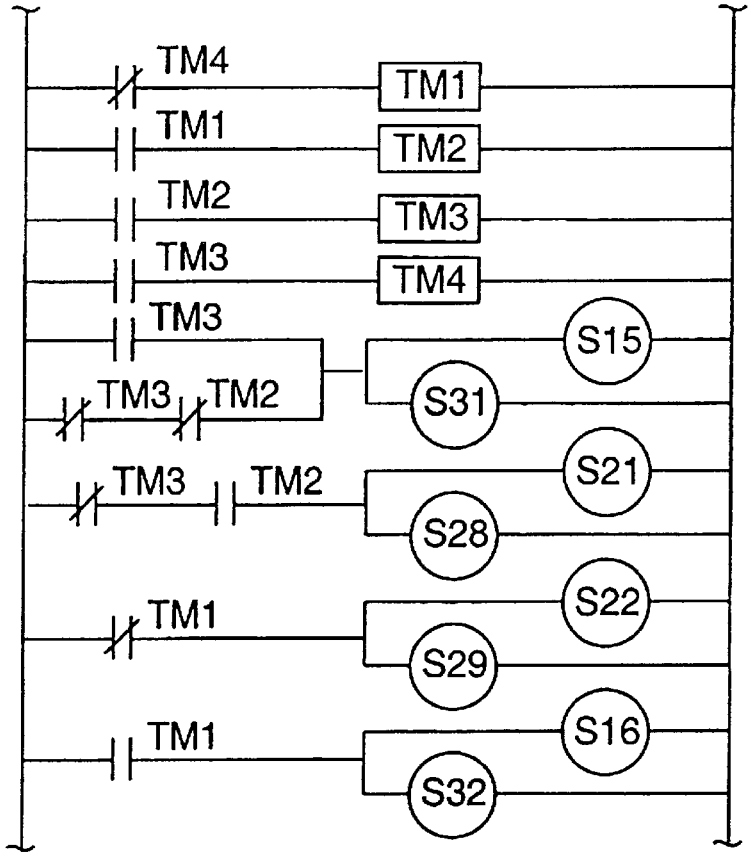
FIG. 3 is a schematic diagram of an alternate design of an electric circuit usable with the embodiment depicted in FIG. 1.

Referring to Table 1 and FIG. 1, during first cycle half I, valves 15 and 31 are open and injection fluid is being delivered from chamber 24 to point 13. Valves 22 and 29 are open and chamber 25 has been fully filled with injection fluid. In intermediate stage IA, valves 22 and 29 are closed and valves 16 and 32 are opened. This allows chamber 25 to start delivering injection fluid while chamber 24 is still delivering injection fluid. Since the flow rate of injection fluid delivered to conduit C is controlled by the pressure differential from point 12 to point 14, this flow rate will not be affected whether one or both vessels 19, 20 are delivering injection fluid to the conduit. The system then shifts to second cycle half II in which valves 15 and 31 are closed and valves 21 and 28 opened and chamber 24 now fills with injection fluid. The system shifts back to intermediate stage IA, in which both chambers 24, 25 deliver injection fluid to conduit C, and returns to cycle half I as described above. Thus, in the disclosed overlapping cycling strategy there is no period in which flow is momentarily interrupted. The duration of intermediate stage IA can vary, but in the depicted embodiment is substantially less than the duration of either first or second cycle halves I, II. FIG. 3 shows a circuit schematic that achieves overlapping cycling. TM1, TM2, TM3 and TM4 are timers which, when energized, will delay closing their respective contacts for a fixed time. When power is applied to the circuit, TM1 is energized and solenoid valves S15, S31, S29 and S22 are energized open. This corresponds to state I of Table 1. When timer TM1 closes its contacts after a first fixed time, timer TM2 is energized, solenoid valves S29 and S22 are de-energized closed and solenoid valves S32 and S16 are energized open. This corresponds to State IA of Table 1. When timer TM2 closes its contacts after a second fixed time, timer TM3 is energized, solenoid valves S28 and S21 are energized open, and solenoid valves S15 and S31 are de-energized closed. This corresponds to state II of Table 1. When timer TM3 closes its contacts after a third fixed time, timer TM4 is energized and solenoid valves S28 and S21 are de-energized closed. This corresponds to state IA of Table 1. When timer TM4 closes its contacts after a fourth fixed time, timer TM1 is de-energized which in turn de-energizes timer TM2, which de-energizes TM3, which de-energizes TM4. The system is thereby reset and the timing cycle starts again.

The timing circuit to cycle the valves may also be accomplished by hydraulic, pneumatic or mechanical means and should not be limited to electrical timers. Furthermore, the cycling of the valves may be accomplished by methods other than a timing circuit. For instance, the positions of the bladders or diaphragms may be sensed by mechanical, optical, magnetic or other means and the valves can be switched before the diaphragm or bladder has reached its limit of fiee travel. Such sensing would thus not affect the accuracy of proportioning.

Another way to cycle the valves is to use a hydraulic valve, which immediately senses a pressure differential between two opposite chambers as one chamber empties and initiates the reversal of the cycle. This system is similar to those typically used in hydraulically operated machine tools, such as grinding machines, which must rapidly cycle back and forth between end points.

The present invention can be varied in many ways. For instance, valves 15, 31, 21, 28, 16, 32, 22 and 29 may be electrically, hydraulically, pneumatically or mechanically actuated. In addition, more than two vessels may be used to pump injection fluid A. Valves 15, 31, 21, 28, 16, 32, 22, and 29 could also be replaced by four 3-way valves or two 4-way valves to reduce the number of components. One of ordinary skill in the art could make such a replacement.

Figure 4A:
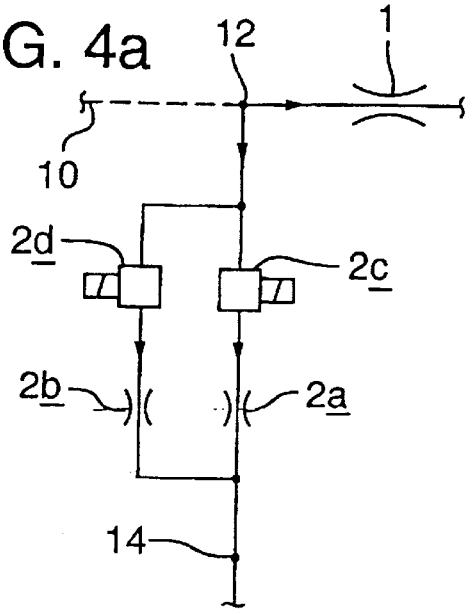
FIG. 4*a* is a schematic diagram showing a variation in the arrangement of the pressure differential creating devices depicted in FIG. 1.
Figure 4B:
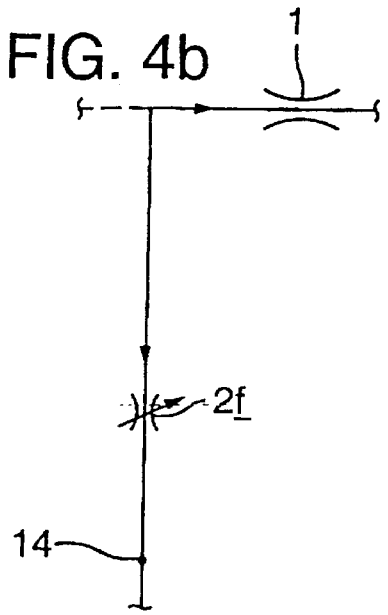
FIG. 4*b* is another schematic diagram showing a variation in the arrangement of the pressure differential creating devices depicted in FIG. 1.

Second pressure differential creating device 2, as shown in FIG. 1, has one fixed orifice size and thus would provide only one proportioning rate between working fluid B and injection fluid A. To obtain different proportioning rates multiple pressure differential creating devices between points 12 and 14 may be used. As shown in FIG. 4*a,* pressure differential creating devices 2*a,* 2*b* are arranged in parallel and can be selectively accessed by opening and closing valves 2*c,* 2*d.* Either or both of devices 2*a*, 2*b* may be opened to vary the proportioning rate. Device 2 may also comprise an adjustable orifice such as a metering valve 2*f* (FIG. 4*b*).

Figure 5:
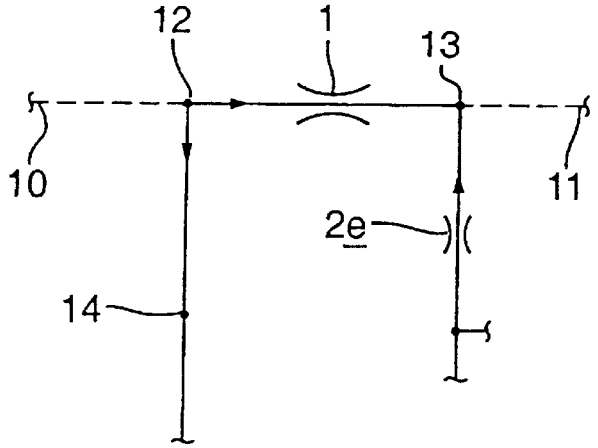
FIG. 5 is a schematic diagram showing another variation in the arrangement of the pressure differential creating devices depicted in FIG. 1.

In the embodiment depicted in FIG. 1, second pressure differential creating device 2 is located between points 12 and 14 so that it has the same fluid flowing through it, working fluid B, as does first pressure differential creating device 1 in conduit C. This makes the accuracy of the fluid proportioning easier to achieve particularly if there is a large difference of viscosity and/or specific gravity between the working fluid and the injection fluid. In certain applications, the injection fluid may also contain particulates and strings of solid material which could damage or plug second device 2 if it were located in the injection fluid lines, which normally present the smallest flow area between points 12 and 13. However, if in a certain application it is better to move the second pressure differential device 2 into the line with injection fluid as shown in FIG. 5, the purpose and function of device are essentially the same, and such a variation is within the scope of the present invention.

Figure 6:
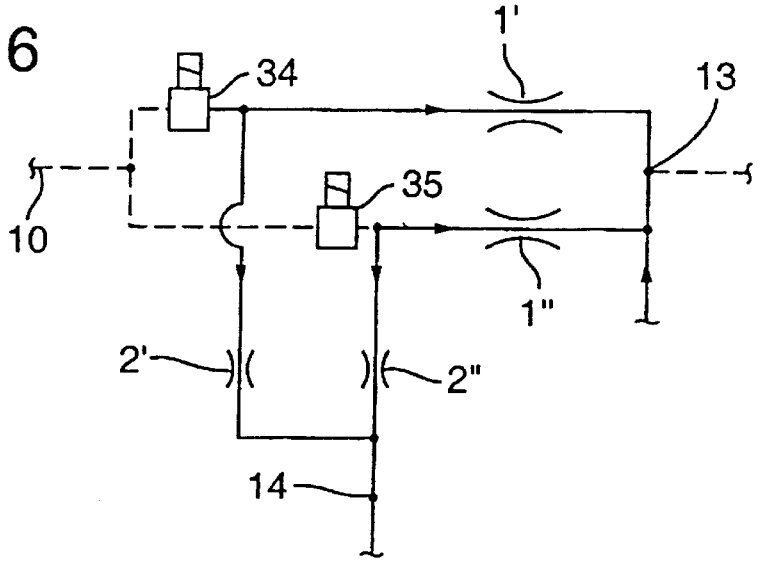
FIG. 6 is a schematic diagram showing another variation in the arrangement of the pressure differential creating devices depicted in FIG. 1.

The pressure flow relationship for pressure differential creating device 1 as described in previous paragraphs will hold true for a certain flow range for a particular size and geometry of device 1. For devices such as orifices and venturis, this range is typically 4:1 or 5:1. In some applications it may be required to proportion over a wider flow range than this. To maintain accuracy, it may be desirable to provide two pressure differential creating devices 1' and 1" connected in parallel with each other (FIG. 6). Devices 1' and 1" are controlled by valves 34 and 35 which open or close depending on the flow rate of working fluid B through conduit C. Each device 1', 1" is connected to a pressure differential creating device 2' and 2", respectively, so that proper proportions between injection fluid and working fluid are maintained.

FIGS. 7–14 show three further embodiments of the invention. Commonly available components have been used in these embodiments and are arranged and interconnected in such a manner as to produce the function or functions described in previous paragraphs. Using readily available components reduces design and construction time, guarantees a reliable supply of replacement parts, and provides the reliability of tested technology. The scope of the invention, however, is not limited to the use of readily available components. To the greatest extent possible, similar components in the different embodiments are given similar reference numbers. For example, first and second vessels are designated 19 and 20, respectively, in FIG. 1, 119, 120 in FIGS. 7–9, and 219, 220 in FIGS. 10–13.

Figure 7:
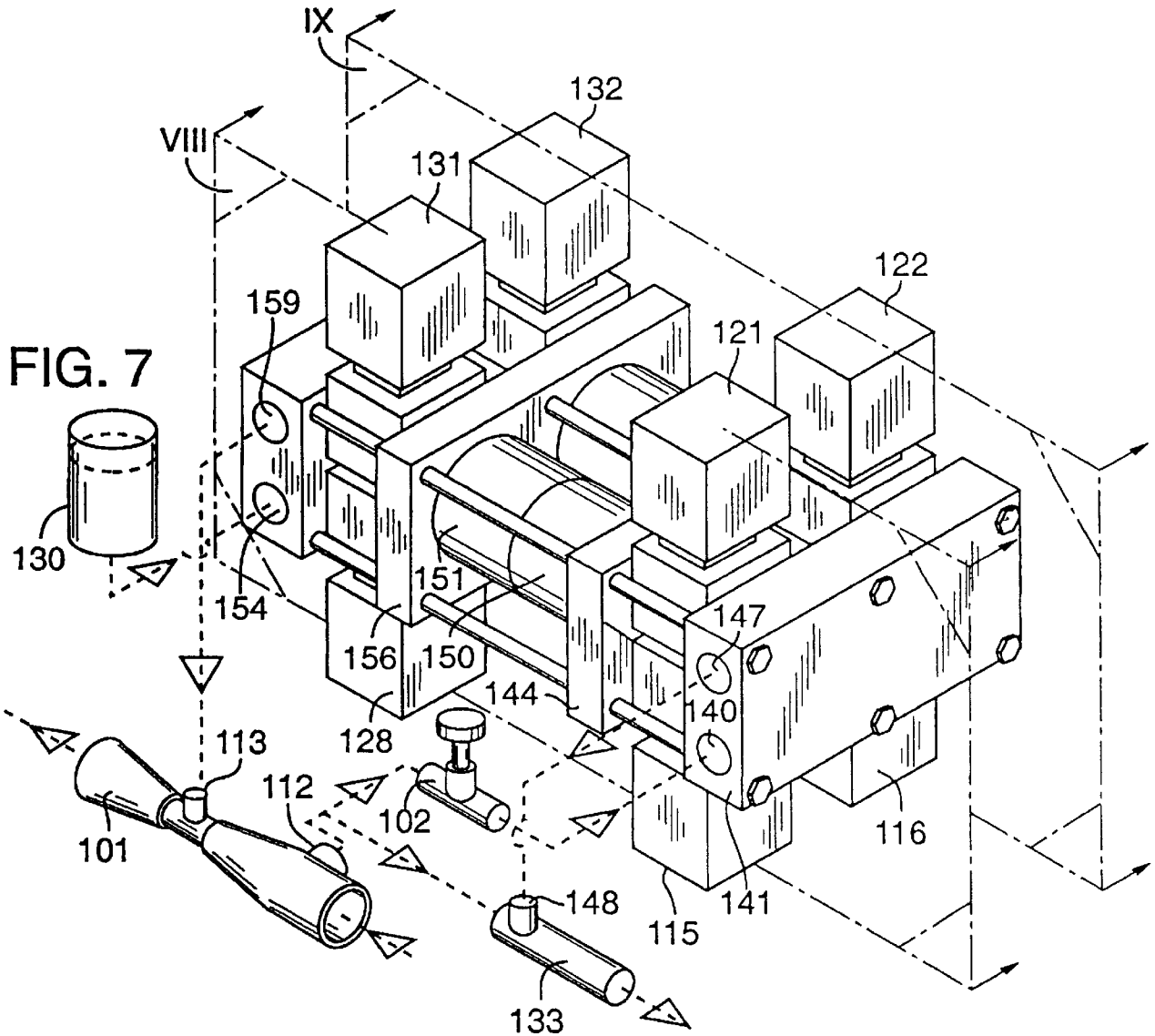
FIG. 7 is a perspective view of another preferred embodiment of the present invention.
Figure 8:
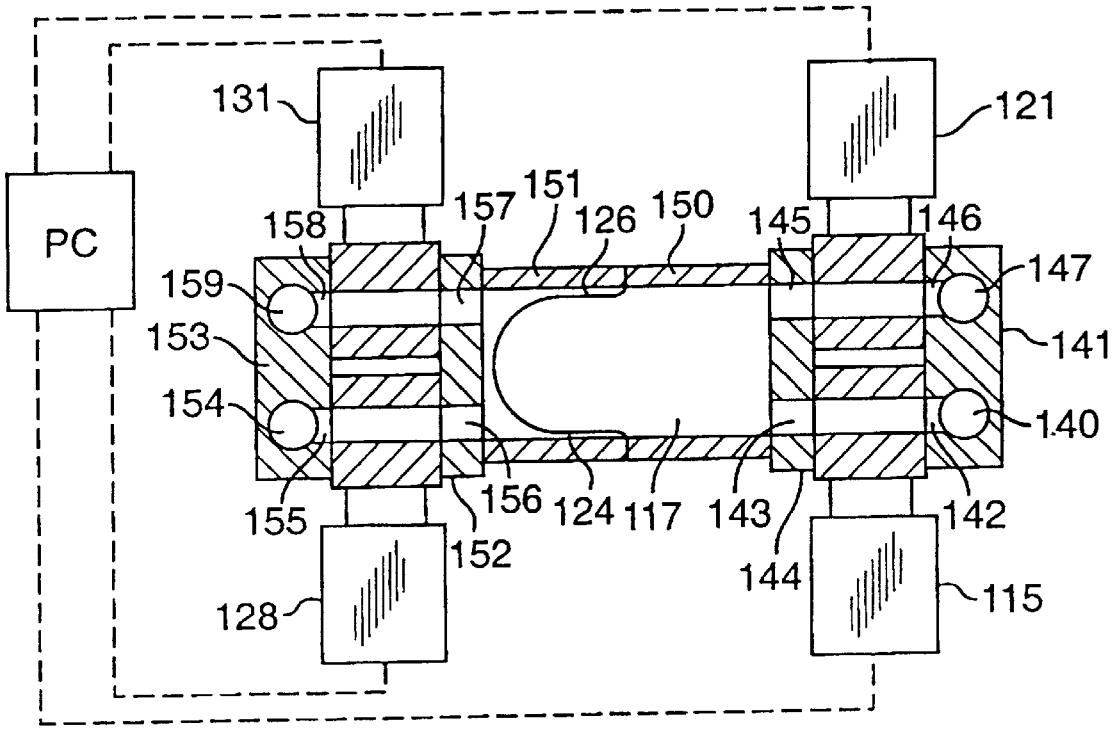
FIG. 8 is a sectional view taken along plane VIII in FIG. 7.
Figure 9:
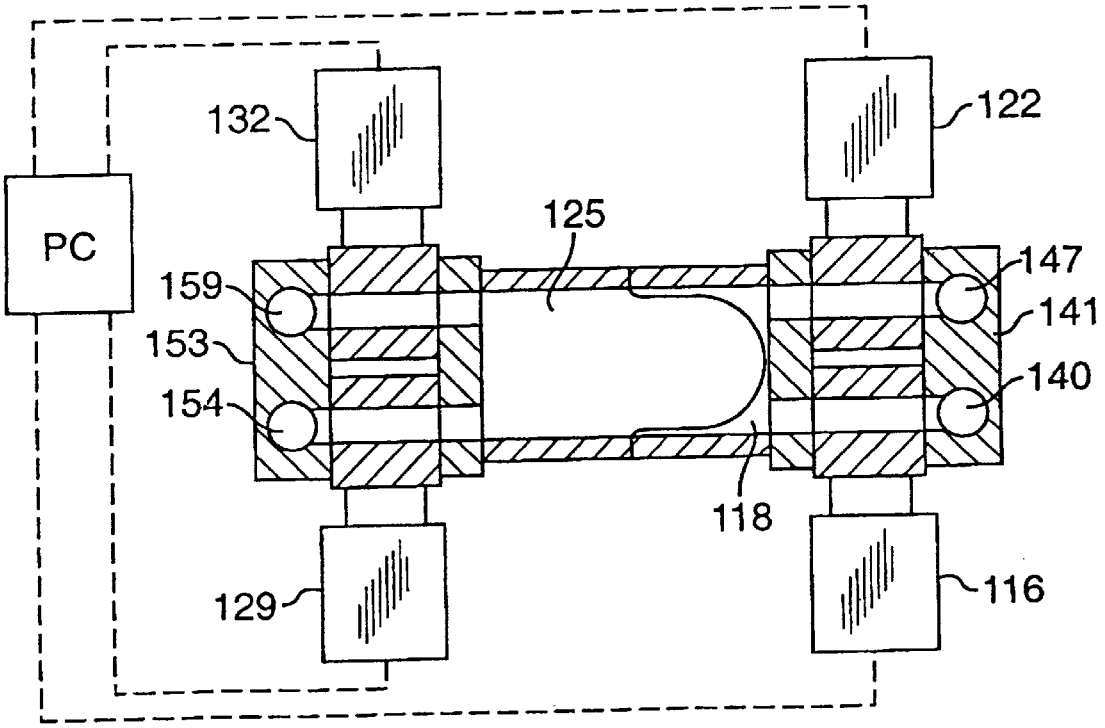
FIG. 9 is a sectional view taken along plane IX in FIG. 7.

FIGS. 7, 8 and 9 show a proportioning system that employs a stacked arrangement in which manifolds, valves and diaphragm chambers are held together with tie rods. Gaskets (not shown) are used to seal all mating elements except the diaphragms.

First pressure differential creating device is shown as a venturi 101. A venturi is preferable in many applications because it is able to recover a substantial portion of energy that could be lost using other types of pressure-differential creating devices. Refering to FIGS. 7–8, the working or main process fluid B, which powers the proportioning system, flows from a point 112 upstream of the throat 113 of venturi 101, through a metering valve 102 used to adjust for various desired proportioning ratios, into a passageway 140 in an end plate 141, through a perpendicular passageway 142, through a solenoid valve 115, through a passageway 143 in a midplate 144, and into a chamber 117 in a first vessel 119. First vessel 119 is formed by clamping a diaphragm between two cylinders 150 and 151, thereby forming chambers 117 and 124. Cylinders 150, 151 may be made from metal or plastic pipe or tubing. Plates 152 and 153 are provided which, together with cylinder 151 and valves 131 and 128, form the injection fluid side for one-half of the system.

Working fluid B to be drained from chamber 117 is conveyed through a passageway 145 in midplate 144, through a solenoid valve 121, through a perpendicular passageway 146, and into a passageway 147. Passageway 147 is connected to the throat 148 of a jet pump 133, which provides suction to draw working fluid out of chamber 117. The inlet of jet pump 133 is connected to the upstream side of venturi 101 at port 112. The discharge ofjet pump 133 is returned to the working fluid process system somewhere at a low pressure point in the system. Since pressure and flow variations from tank 130 to vessels 119 and 120 do not affect the flow rate from point 114 to throat 113 and thus do not affect proportioning accuracy, a variety of other feeding or draining devices can be used.

Injection fluid from an external open tank 130 flows into a passageway 154, through a perpendicular passageway 155, through a solenoid valve 128, through a passageway 156 in plate 152, and into chamber 124. Injection fluid is delivered out of chamber 124, through flow passageway 157, through valve 131, through a perpendicular passageway 158, and into a passageway 159. Passageway 159 is connected by a hose or pipe to throat 113 of venturi 101 located remotely in the main process line C.

FIG. 9 shows a cross-section view of the other half of the proportioning pump, and is identical in structure to FIG. 8.

As shown schematically in FIGS. 8–9, electrically actuated solenoid valves 115, 131, 121, 128, 116, 132, 122, 129 are controlled by a programmable controller PC.

If valves 115 and 131 are controlled by controller PC to be open and valves 121 and 128 are controlled to be closed, working fluid from ventuwi port 112 enters port 140 and pressurizes chamber 117 (FIG. 8). This pressure is transmitted to chamber 124 by diaphragm 126, which pushes injection fluid through port 159 to the low pressure point 113 of venturi 101.

Referring to FIGS. 7 and 9, at the same time injection fluid is delivered to conduit C from chamber 124, injection fluid is being transferred fiom an external open tank 130 into chamber 125. Programmable controller PC has opened valves 122 and 129. Valves 116 and 132 are closed. Injection fluid will flow from tank 130 through passageway 154 and into chamber 125. Working fluid is evacuated through passageway 147 by the suction connection 148 of the jet pump 133 creating the necessary pressure gradient to produce the required flow rate.

FIGS. 10–13 show another system used for proportioning firefighting foam concentrate on fire trucks. In this system, the working fluid is water and the injection fluid is one of two types of firefighting foam concentrate A1, A2. This unit is designed to combine foam concentrate with water at rates and pressures encountered in a firefighting environment. Of course, the size of the components can be enlarged or reduced to accommodate different flow rates and pressures encountered in different environments.

Water B for fighting fires is pumped fiom hydrants into the fire truck by a truck pump 200 and flows through a check valve 284 and through a venturi 201. The exit of venturi 201 is connected to the outgoing fire hose or hoses.

Junction point 212, located upstream of venturi 201, diverts a portion of the pumped water through a strainer 260, through a hose and into pipe junction 261. Pipe junction 261 separates the water into two paths. One path delivers water through a manifold check valve 286 to a manifold 262, which contains three orifices 202, 202' and 202" of different sizes. Orifices 202, 202' and 202" are controlled by solenoid valves 263, 263' or 263" respectively. A user may control the ratio of foam concentrate to water by selecting one or a combination of orifices through which water will flow. Water exiting manifold 262 flows into pipe junction 264, through either solenoid valve 215 or 216 and into either chamber 217 or 218 of vessels 219 or 220 respectively.

Figure 10:
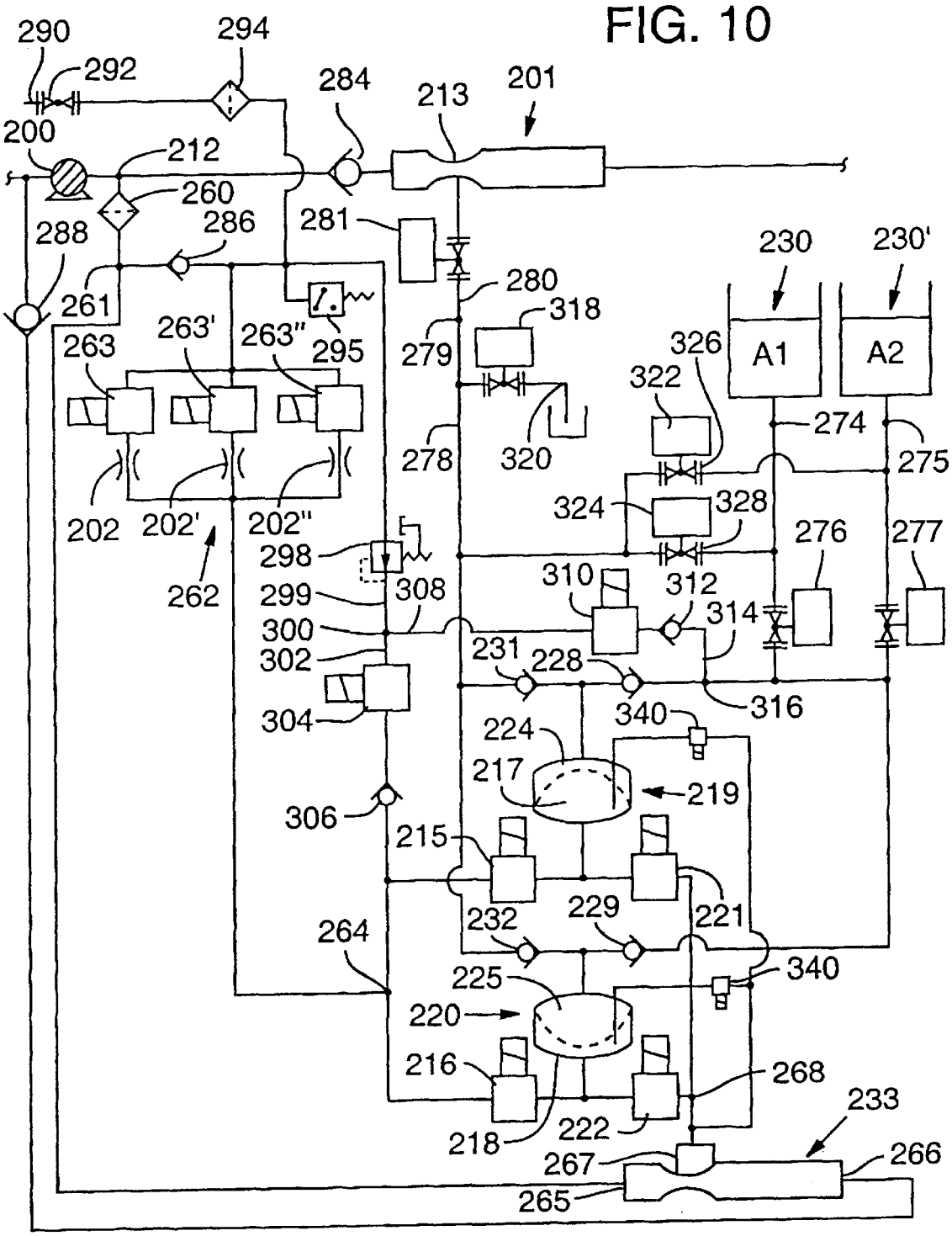
FIG. 10 is a schematic diagram showing the hydraulic arrangement of still another embodiment of the present invention.
Figure 13:
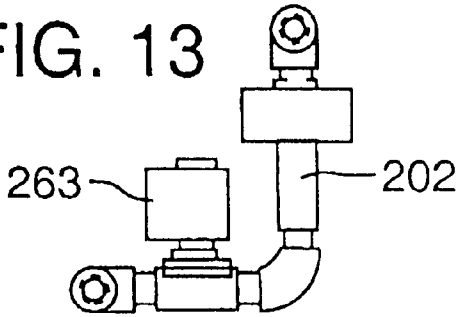
FIG. 13 is a side elevational view of the proportioning manifold shown in FIG. 12.

The second water path from pipe junction 261 leads to the inlet 265 of a jet pump 233. The exit 266 of jet pump 233 is connected, via a check valve 288, to the suction side of truck pump 200 (FIG. 10).

Jet pump 233 is driven by water B and returns the water drained from chambers 217 and 218 back to a low pressure point in the working fluid process line. Jet pump 233 provides sub-atmospheric pressure that aids in draining water from chambers 217 and 218. The additional pressure head so created assists in delivering foam concentrate from tanks 230, 230' if the tanks are above chambers 224, 225, and can lift foam concentrate from the tanks into the system if the tanks are located below chambers 224, 225. Jet pump 233 could be replaced by any suitable type of externally or internally powered fluid pump that will provide adequate pressure for draining water out of the system and drawing foam concentrate into the system.

The throat 267 of jet pump 233 is connected to pipe junction 268. Water contained in chamber 217 or 218 of vessels 219 or 220, respectively, is sucked out through solenoid valves 221 or 222 and into the throat ofjet pump 233.

Figure 11:
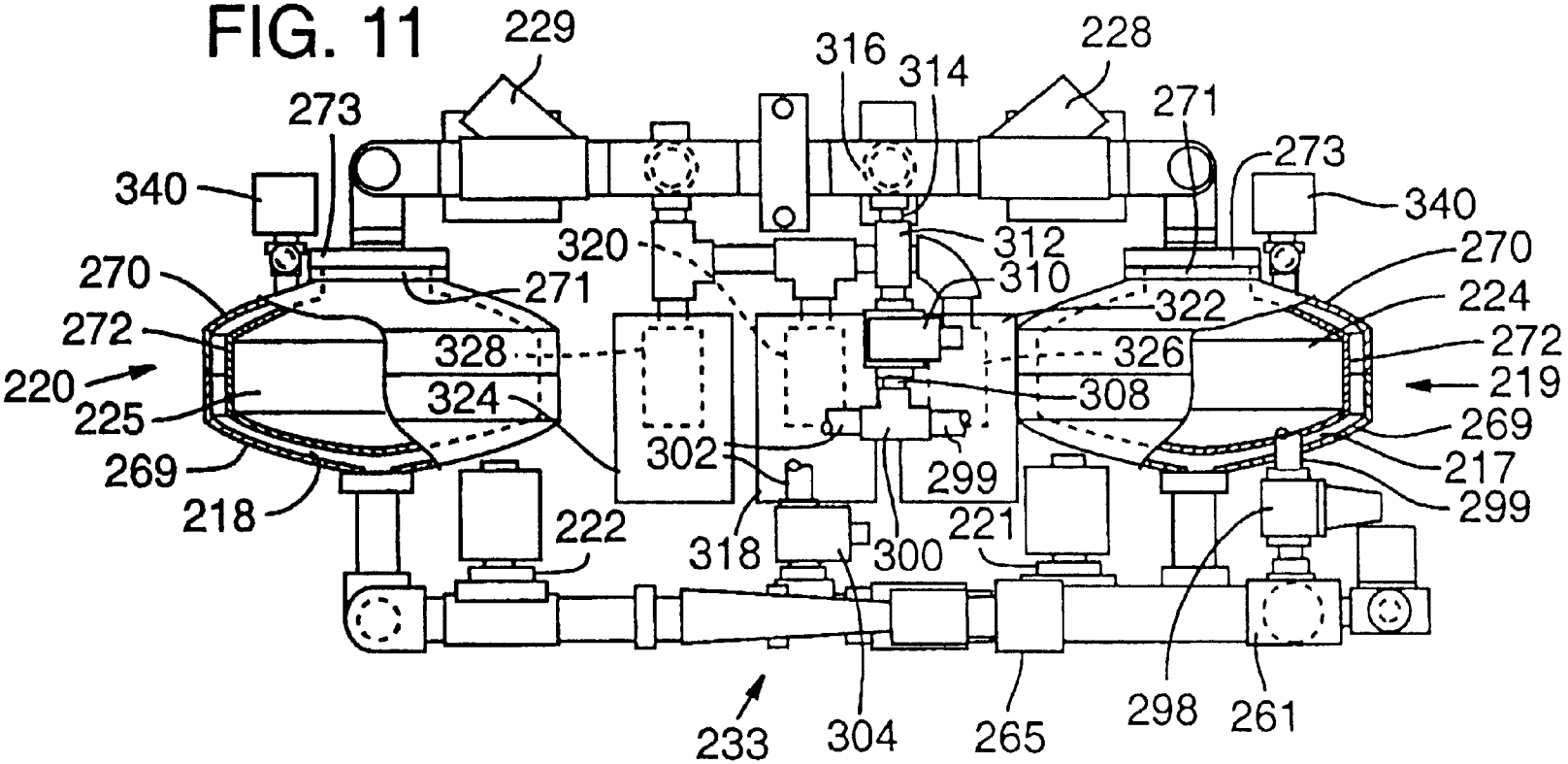
FIG. 11 is an elevational view of a proportioning system arranged according to FIG. 10.
Figure 12:
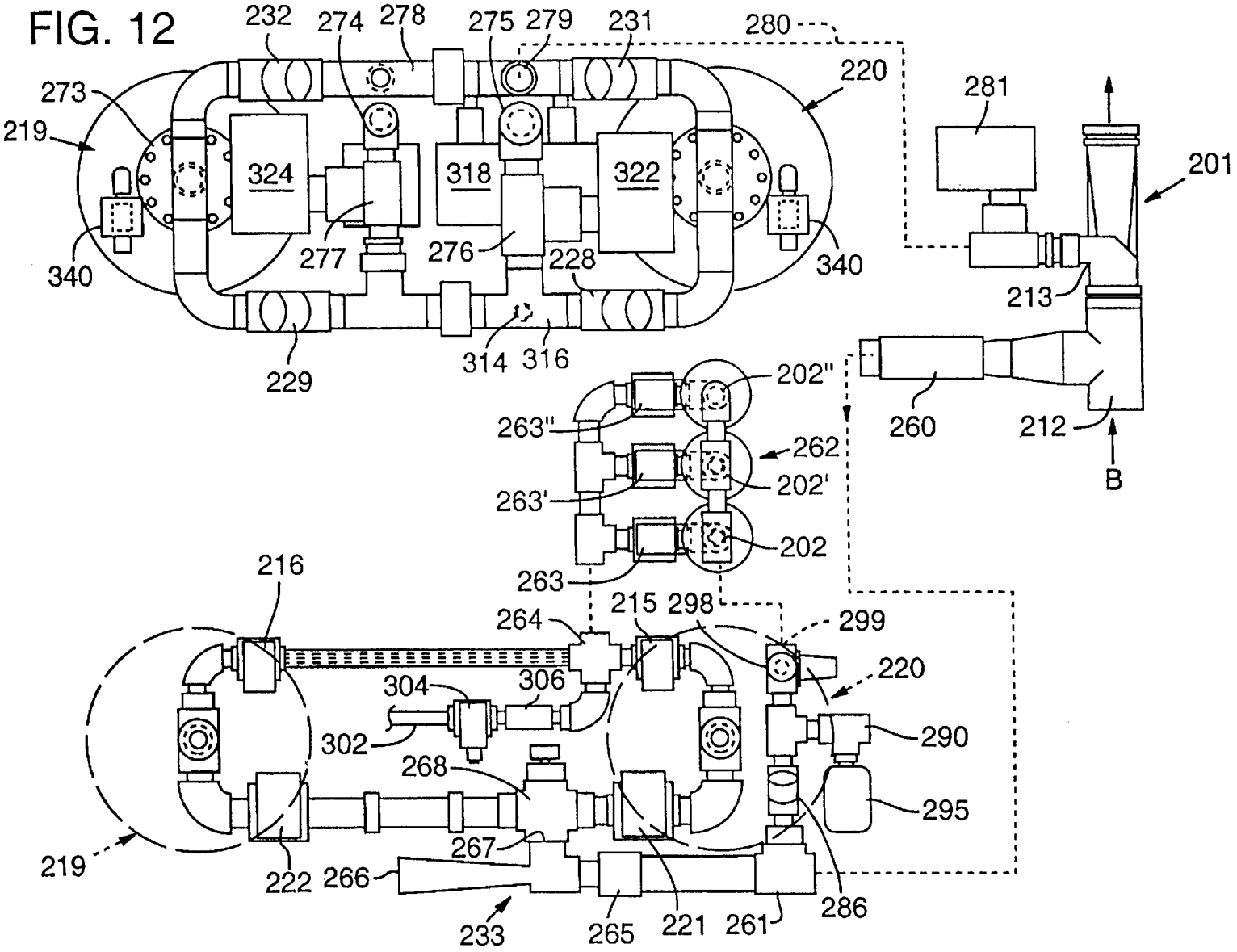
FIG. 12 is a plan view showing the proportioning system of FIG. 11 in exploded form.

Each of vessels 219 and 220 consist of two tank heads 269 and 270 which have been welded together (FIG. 11). One tank head on each vessel has a flanged hole 271. A water bladder 272 is inserted into each vessel and held in place between flanges 273 and 271.

Water bladder 272 forms two chambers within each vessel. Chambers 217 and 218 contain the pressurized water, while chambers 224 and 225, formed from the inside of the bladder 272, contain the firefighting foam concentrate.

First and second foam concentrate inlets 274, 275 are respectively connected to first and second open tanks 230 and 230', which contain two different types of firefighting foam concentrate Al, A2. Foam concentrate from either one tank or the other flows through one of a pair of tank control valves 276 or 277, through check valves 228, 229 and into chambers 224, 225 in vessels 219 and 220 respectively.

Foam concentrate being pumped out of chambers 224 or 225 passes through either check valve 231 or 232 into a manifold 278, through an outlet 279 into a hose 280, through a ball valve 281 and into the low pressure area 213 of device 201, where it is mixed in with the water flowing through device 201.

The operation of this proportioner pump design is similar to that of previously described embodiments. Solenoid valves 215, 222 are energized open while solenoid valves 216, 221 are closed. Either solenoid valve 263 or 263' or 263" is energized open.

In the depicted embodiment, a plurality of check valves 228, 229, 231, 232 are used instead of the solenoid-actuated valves depicted in previous embodiments. In systems having high working fluid flow rates such as the depicted embodiment, solenoids or other externally actuated valves would need to be so large as to be too expensive, too bulky, or simply unavailable. Check valves 228, 229, 231, 232 adequately control the flow of foam concentrate in and out of chambers 224, 225.

Pressurized water fiom point 212 flows through solenoid valve 215 into chamber 217 and pushes foam contained in chamber 224 out through check valve 231, through outlet 279 and into the low pressure area 213 of device 201. Water contained in chamber 218 is drained out through solenoid valve 222 and into the throat 267 of jet pump 233. Depending on which tank 230, 230' of foam concentrate has been selected, the foam concentrate flows into inlet 274 and valve 276 or into inlet 275 and valve 277. The foam concentrate flows through check valve 229 and into chamber 225 where it fully fills this chamber. This sequence takes approximately six seconds. At the end of this sequence solenoid valves 215, 222 are closed and solenoid valves 216, 221 are opened. Vessel 220 now pumps out foam concentrate while vessel 219 fills with foam concentrate. The alternate filling and pumping cycle is repeated and provides continuous proportioning of foam concentrate in the water lines of the fire truck.

The system depicted in FIGS. 10–13 permits the use of two or more types of foam concentrate A1 and A2, each of which is used for a different type of fire. For example, foam concentrate Al may be suitable to extinguish a wood-fueled fire, while foam concentrate A2 may be suitable to extinguish a petroleum-fueled fire. To ensure constant readiness, the system is designed to allow one of foam concentrates A1 or A2 to remain within the system when the system is not in use. However, if it is desired to use the foam concentrate that is not in the system, e.g., switching from A1 to A2, foam concentrate A1 must be emptied from chambers 224, 225 before foam concentrate A2 is directed thereto. Since the foam concentrates are expensive, it is desirable to return any unused foam concentrate in chambers 224, 225 to tanks 230, 230' before switching foam concentrates or cleaning the system. A network of valves and passages, described below, permit the switching of foam concentrates and the salvaging of any unused foam concentrate within chambers 224, 225.

An alternate water source 290 supplies water to the system for testing or cleaning purposes. For instance, a garden hose or a water source at a fire station 290 can be connected to manifold 262. Water source 290 allows the system to be cleaned or tested without engaging truck pump 200. Water source 290 typically includes a shutoff valve 292 and a strainer 294. The system is connected to an electrical power source (not shown) on the fire track through a pressure switch 295 located upstream of manifold 262. Water from pump 200 or water source 290 closes the contacts of pressure switch 295 and permits the control of the system to be powered by the power source.

A manifold check valve 286 prevents water from water source 290 from flowing into junction 212, thus maintaining water pressure in the system. Water from water source 290 closes the contacts on pressure switch 295 and flows into a pressure reducing valve 298 which moderates fluid flow to prevent damage to bladders 272 during the draining and cleaning cycles. Water flows from pressure reducing valve 298, through a passage 299 (only partially shown in FIG. 11), and to a pipe junction 300.

A manifold bypass passage 302 extends fiom pipe junction 300 and leads to a solenoid-actuated manifold bypass valve 304, a check valve 306, and a junction 264. A foam flush passage 308 extends from pipe junction 300 and leads to a solenoid actuated flush valve 310, a check valve 312, a passage 314, and a junction 316.

A discharge valve 318 is disposed upstream of low-pressure region 213 of venturi 201. A venturi cut-off valve 281 is disposed between discharge valve 318 and low-pressure region 213. When discharge valve 318 is opened and venturi cut-off valve 281 is closed, fluid in manifold 278 may be discharged through a connection 320 without passing through venturi 201. Also disposed upstream of low-pressure region 213 are first and second foam saving valves 322, 324 which connect via connections 326, 328 to first and second tanks 230, 230', respectively. A pair of vent valves 340 connect to chambers 217, 218, respectively and discharge into jet pump throat 267. Vent valves 340, opened any time manifold bypass valve 304 is opened, permit any air trapped in chambers 217, 218 to be pushed out during the cleaning/flushing process. During a normal proportioning operation of the system, manifold bypass valve 304, flush valve 310, discharge valve 318, and first and second foam saving valves 322, 324 are closed and ball valve 281 is open. As previously described, at least one of manifold valves 263, 263', and 263" are open and one of tank control valves 276, 277 is open.

To switch to foam concentrate A2 when foam concentrate A1 is in the system, the operator first empties chambers 224, 225 of foam concentrate A1 and returns as much of foam concentrate A1 as possible into tank 230. This is done by closing manifold valves 263, 263' and 263", tank control valves 276, 277, valves 221, 222 and 281, and opening manifold bypass valve 304, second foam saving valve 324, and valves 215 and 216. Water either pumped by pump 200 or provided by water source 290 flows through passage 299 to pipe junction 300, through manifold bypass valve 304 and check valve 306, through valves 215, 216, and into chambers 217 and 218. The water in chambers 217, 218 pushes foam concentrate A1 out of chambers 224, 225, respectively, through check valves 231 and 232, through second foam saving valve 324, and into tank 230. Pressure regulating valve 298 prevents high pressure from building up in chambers 217, 218.

Once chambers 224, 225 are substantially empty of foam concentrate A1, any remaining foam concentrate A1 is cleaned or flushed out of the system. This is done by closing second foam saving valve 324, manifold bypass valve 304, and valves 215, 216, and by opening foam flush valve 310 and valves 221 and 222. Water either pumped by pump 200 or provided by water source 290 flows through pressure reducing valve 298, junction 300, foam flush passage 308, flush valve 310, check valve 312, passage 314 and to junction 316. The water then flows through check valves 228, 229, and into chambers 224, 225 until the chambers are fill. The water within the chambers and the piping connected thereto is pumped out through connection 320 by opening manifold bypass valve 304, bypass valve 318, and valves 215 and 216. Water either pumped by pump 200 or provided by water source 290 flows through passageway 299 to pipe junction 300, through manifold bypass valve 304 and check valve 306, through valves 215 and 216 and into chambers 217, 218. The water flowing into chambers 217, 218 pushes water out of chambers 224, 225, respectively, through check valves 231, 232, through discharge valve 318, and out connection 320. The system is now in a clean state.

Foam concentrate A2 is introduced into the system by closing remote discharge valve 318, foam flush valve 310 and by opening tank control valve 277 and valves 221, 222. Foam concentrate A2 is drawn into chambers 224, 225 as chambers 217 and 218 are emptied of water. Ball valve 281 is then opened and one of manifold valves 263, 263' and 263" is opened to effect a desired foam/water ratio. The system is ready for use with foam concentrate A2. The draining/cleaning/filling process as described above is repeated when it is desired to switch from foam concentrate A2 to foam concentrate A1.

Figure 14:
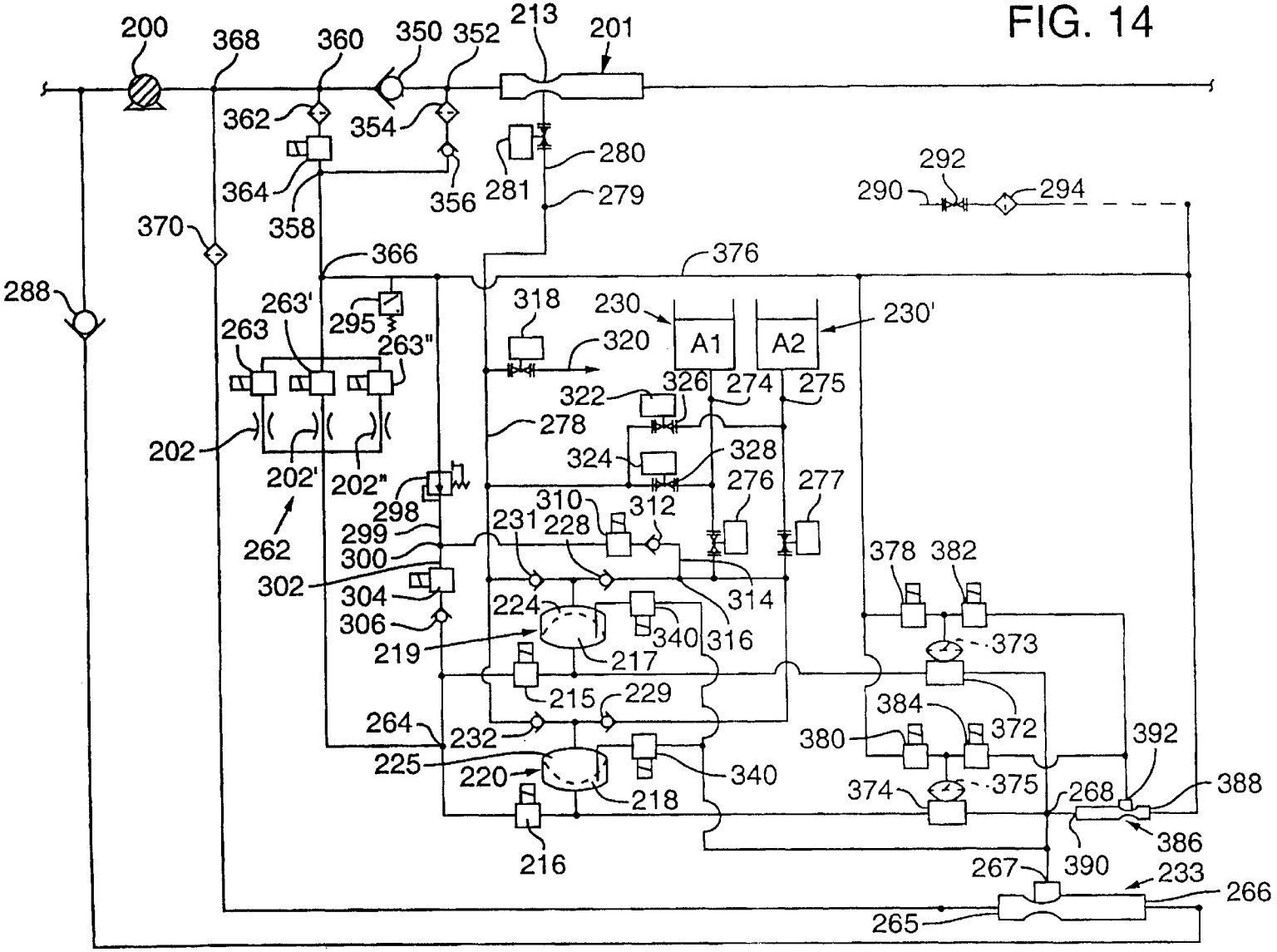
FIG. 14 is a schematic diagram showing the hydraulic arrangement of yet another embodiment of the present invention.

As previously stated, the present invention may be used to proportion firefighting foam concentrates of various viscosities into a stream of water. A foam concentrate having a very high viscosity may have difficulty moving through the pipes and valves of the system, and it may therefore be necessary to selectively increase the pressure differential within the system to urge highly viscous foam concentrate to flow at the required rates. FIG. 14 shows another embodiment of the present invention, which is the most preferred embodiment, that provides an increased pressure within the proportioning system when combining a working fluid, such as water, with a high-viscosity injection fluid, such as a high-viscosity firefighting foam concentrate. The embodiment depicted in FIG. 14 is similar in structure and operation to the embodiment depicted in FIGS. 10–13, and similar components are given the same reference numbers. Only those components necessary to explain the differences between the two embodiments will be discussed below.

Water is pumped by pump 200 and travels through a check valve 350 and into venturi 201. Water passes through check valve 350 to the venturi when the pressure of the water pushes back a spring (not shown) contained inside the check valve. A first water diverting junction 352 is disposed on one side of check valve 350 and diverts water through a strainer 354, a check valve 356, and to a junction 358. A second water diverting junction 360 is disposed on the other side of check valve 350 and diverts water through a strainer 362, through a high-viscosity valve 364, and to junction 358. Water from either first or second water diverting junctions 352, 360 travels from junction 358 to a junction 366 where it enters the remainder of the system. A third water diverting junction 368 is disposed upstream of second water diverting junction 360 and diverts pumped water through a strainer 370 and into the inlet of jet pump 233. Water exiting jet pump 233 flows through a check valve 288 to the upstream side of pump 200.

When a low viscosity injection fluid is used with the system, high-viscosity valve 364 is closed and pumped water flows through check valve 350 and first water diverting junction 352. The pumped water flows to venturi 201 and through check valve 356 to reach junction 358. When a high viscosity injection fluid is used, high viscosity valve 364 is opened and water is partially diverted through second water diverting junction 360. Water flowing to venturi 201 must pass through check valve 350, which lowers the pressure of water flowing therethrough. Check valve 356 prevents the higher pressure water flowing through high viscosity valve 364 from bypassing check valve 350. If it is known how much of a pressure drop is needed to urge movement of a specific viscous injection fluid in the system, a spring having a spring constant sufficient to create the required pressure drop may be placed in check valve 350. Alternatively, a valve that exerts a variable pressure on the pumped water may be used in addition to or in place of check valve 350. Such a variable pressure valve would enable the proportioning system to adjust the pressure differential for use with injection fluids having a wide range of viscosities.

The rate of combining foam concentrate with water may be increased by decreasing the time necessary for water to drain out of chambers 217 and 218 of vessels 219 and 220, respectively. As shown in FIG. 14, this may be done by replacing solenoid valves 221, 222 with first and second pilot-operated diaphragm valves 372, 374. As is known in the art, each diaphragm valve 372, 374 contains a flexible diaphragm 373, 375, and each diaphragm 373, 375 has an actuator (not shown) attached thereto. The actuator is typically spring-biased to a position in which it is normally not causing a fluid path to be blocked. If pilot pressure applied to one side of the diaphragm is sufficient to overcome the spring-bias, the diaphragm moves in response to the pilot pressure and the actuator moves to cause the fluid path to be blocked. Removing pilot pressure causes the diaphragm valve to return to its original position. In the depicted embodiment, water from junction 366 (via a passage 376) supplies a pilot pressure to diaphragm valves 372, 374. First and second pilot inlet solenoid valves 378, 380, control the entrance of water into diaphragm valves 372, 374, respectively, and first and second pilot outlet solenoid valves 382, 384 control the draining of water out of the diaphragm valves. A secondary jet pump 386 has an inlet 388 connected to passage 376, an outlet 390 connected to junction 268, and a throat 392 connected to first and second pilot outlet solenoid valves 382, 384. Secondary jet pump 386 provides a suction pressure that aids in draining diaphragm valves 372, 374.

To fill chamber 217 with water, first pilot inlet solenoid valve 378 is opened and first pilot outlet solenoid valve 382 is closed. As explained above, water at a pilot pressure flows from junction 366 and acts on diaphragm 373 within diaphragm valve 372 to prevent water in chamber 217 from passing through diaphragm valve 372. Valve 215 is opened and chamber 217 is filled with water. To empty chamber 217, valve 215 and first pilot inlet solenoid valve 378 are closed and first pilot outlet solenoid valve 382 is opened. Water drains from diaphragm 373 of diaphragm valve 372 through throat 392 of secondary jet pump 386 and water from chamber 217 passes through diaphragm valve 373 to junction 268. Chamber 218 is drained and filled in a similar manner, using valve 216, diaphragm valve 374, second pilot inlet solenoid valve 380, and second pilot outlet solenoid valve 384. Diaphragm valves 372, 374 allow chambers 217, 218 to be drained more quickly, thereby increasing the rate at which foam concentrate may be combined with water.

One advantage of the present invention is that injection fluid is mixed with working fluid at a constant, predetermined ratio. Changes in flow rate or pressure in conduit C do not affect the predetermined ratio. This is particularly advantageous in firefighting applications where the ratio of foam concentrate to water must be kept constant regardless of flow rate or pressure fluctuations.

Another advantage of the present invention is that injection fluid is drawn through the various passages and valves by the pressure differences created by the first and second pressure differential creating devices. No auxiliary pump is needed to pump injection fluid through the system.

Another advantage of the present invention is that the alternating filling and emptying cycle of the two vessels provides a constant and continuous flow of injection fluid into the working fluid from an open tank.

Another advantage of the present invention is that the draining and cleaning process can be performed without engaging truck pump 200. Water source 290, which can be a garden hose or a station house connection, provides the necessary water to drain and clean the system. In addition, the flushed foam concentrate does not travel through venturi 201 or through any fire hoses attached thereto. In addition, flushed foam concentrate bypasses venturi 201 as it is expelled through remote discharge valve 318. This is advantageous because venturi 201 does not become clogged with a potentially high concentration of foam concentrate during the flushing process.

As previously stated, the present application is particularly effective as a firefighting foam proportioner installed on a fire truck, but can also be used in other ways. For instance, the present invention can be used to proportion firefighting foam in a sprinkler system within a building. The present invention can also be used to inject pesticides, fertilizers, or other fluids into an agricultural sprinkler system. The present invention can have applications in the medical field where two fluid flows must be continuously combined at a fixed ratio. For these and other applications, the size of the present invention can be varied according to the required flow rates and pressures in the particular application.

The foregoing description of the preferred embodiments of the invention has been presented for purposes of illustration and description. It is not intended to be exhaustive or to limit the invention to the precise form disclosed, and many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined only by the claims.

What is claimed is:

1. An apparatus for continuously and proportionately injecting an injection fluid into a pressurized conduit flowing with a working fluid, comprising:

a first vessel enclosing a first flexible element that divides the first vessel between a first injection fluid chamber and a first working fluid chamber;

a second vessel enclosing a second flexible element that divides the second vessel between a second injection fluid chamber and a second working fluid chamber;

a first pressure differential creating device contained within the pressurized conduit and creating therein a first reduced pressure region;

a first conduit network that selectively connects the pressurized conduit to the first and second working fluid chambers;

a second conduit network that selectively connects the first and second injection fluid chambers to the first reduced pressure region in the pressurized conduit;

and a control system that automatically and continuously controls the filling emptying and refilling of the first and second injection fluid chambers and the filling, emptying and refilling of the first and second working fluid chambers while ensuring both a continuous flow of working fluid through the pressurized conduit and a continuous flow of injection fluid into the first reduced pressure region at a predetermined proportion that is independent of working fluid flow rate and pressure.

2. The apparatus of claim 1, further comprising a second pressure differential creating device, disposed within the second conduit network, that creates a second reduced pressure region within the second conduit network.

3. The apparatus of claim 1, wherein the control system includes a plurality of valves arranged within the first and second conduit networks.

4. The apparatus of claim 1, wherein the first pressure differential creating device is a venturi having an inlet, a low-pressure throat, and an outlet;

wherein working fluid enters the inlet of the venturi, and injection fluid from the first and second injection fluid chambers enters the low-pressure throat of the venturi.

5. The apparatus of claim 1, further comprising a working fluid evacuation element, the first and second working fluid chambers draining to the working fluid evacuation element.

6. An apparatus for continuously and proportionately injecting an injection fluid into a pressurized conduit flowing with a working fluid, comprising:

a first pressure differential creating device disposed in and forming part of the pressurized conduit and creating therein a first pressure region and a second pressure region having a lower pressure than the first pressure region;

a second pressure differential creating device creating a first pressure region and a second pressure region having a lower pressure than the first pressure region of the second pressure differential creating device;

a first vessel enclosing a first flexible element that divides the first vessel between a first injection fluid chanber and a first working fluid chamber;

a second vessel enclosing a second flexible element that divides the second vessel between a first injection fluid chamber and a second working fluid chamber;

wherein the first and second injection fluid chambers are selectively connected to the second pressure region of the pressurized conduit and are selectively, automatically and continuously filled, emptied and refilled with the injection fluid, and wherein the first and second working fluid chambers are selectively. automatically and continuously filled with and emptied of the working fluid;

the injection fluid being thereby continuously combined at a predetermined proportion with the working fluid at the low pressure region of the pressurized conduit independent of the working fluid flow rate and pressure while maintaining a continuous flow of working fluid through the pressurized conduit.

7. The apparatus of claim 6, fuither comprising:

first and second working fluid inlet valves operative, when open, to admit working fluid into the first and second working fluid chambers, respectively;

first and second working fluid outlet valves operative, when open, to permit working fluid to exit the first and second working fluid chambers, respectively; and a cycling circuit that selectively opens and closes the first and second working fluid inlet valves and the first and second working fluid outlet valves.

8. The apparatus of claim 7, wherein the cycling circuit has a first state in which working fluid fills the first working fluid chamber and exits the second working fluid chamber, and a second state in which working fluid exits the first working fluid chamber and fills the second working fluid chamber.

9. The apparatus of claim 8, wherein the cycling circuit includes an intermediate state in which working fluid exits the first and second working fluid chambers, wherein the cycling circuit achieves the intermediate state between the first state and the second state.

10. The apparatus of claim 8, wherein in the first state the cycling circuit causes the first working fluid inlet valve to open, the second working fluid inlet valve to close, the first working fluid outlet valve to close, and the second working fluid outlet valve to open; and wherein in the second state the cycling circuit causes the first working fluid inlet valve to close, the second working fluid inlet valve to open, the first working fluid outlet valve to open, and the second working fluid outlet valve to close.

11. The apparatus of claim 7, further comprising:

first and second injection fluid inlet valves operative, when open, to admit injection fluid into the first and second injection fluid chambers, respectively; and first and second injection fluid outlet valves operative, when open, to permit injection fluid to exit the first and second injection fluid chambers, respectively.

12. The apparatus of claim 11, wherein the cycling circuit has a first state in which injection fluid exits the first injection fluid chamber and fills the second injection fluid chamber, and a second state in which injection fluid fills the first injection fluid chamber and exits the second injection fluid chamber.

13. The apparatus of claim 12, wherein in the first state the first injection fluid inlet valve is closed, the second injection fluid inlet valve is open, the first injection fluid outlet valve is open, and the second injection fluid outlet valve is closed; and wherein in the second state the first injection fluid inlet valve is open, the second injection fluid inlet valve is closed, the first injection fluid outlet valve is closed, and the second injection fluid outlet valve is open.

14. The apparatus of claim 12, wherein the cycling circuit includes an intermediate state in which injection fluid enters the first and second injection fluid chambers, wherein the cycling circuit achieves the intermediate state between the first state and the second state.

15. The apparatus of claim 6, further comprising:

first and second injection fluid inlet valves operative, when open, to admit injection fluid into the first and second injection fluid chambers, respectively; and first and second injection fluid outlet valves operative, when open, to permit injection fluid to exit the first and second injection fluid chambers, respectively.

16. The apparatus of claim 15, wherein at least one of the first and second injection fluid inlet valves and the first and second injection fluid outlet valves is a check valve.

17. The apparatus of claim 15, further comprising a timing circuit that selectively opens and closes the first and second injection fluid inlet valves and the first and second injection fluid outlet valves.

18. The apparatus of claim 15, wherein at least one of the first and second working fluid outlet valves is a diaphragm valve.

19. The apparatus of claim 18, wherein the diaphragm valve is actuated by a pilot pressure.

20. The apparatus of claim 19, further comprising:

a pilot inlet valve that selectively permits working fluid to enter and actuate the diaphragm valve; and a pilot outlet valve that selectively drains working fluid from the diaphragm valve to deactuate the diaphragm valve.

21. The apparatus of claim 6, wherein the first and second working fluid chambers are selectively connected to the second pressure region of the second pressure differential creating device.

22. The apparatus of claim 6, wherein the first pressure region of the first pressure differential creating device operates at substantially the same pressure as the first pressure region of the second pressure differential creating device.

23. The apparatus of claim 6, wherein the first and second injection fluid chambers are selectively connected to the second pressure region of the second pressure differential creating device.

24. The apparatus of claim 6, wherein the second pressure region of the first pressure differential creating device operates at substantially the same pressure as the second pressure region of the second pressure differential creating device.

25. The apparatus of claim 6, further including a third pressure differential creating device arranged in parallel with the second pressure differential creating device and having a first pressure region, and a second pressure region with a pressure lower than the first pressure region of the third pressure differential creating device.

26. The apparatus of claim 25, wherein the third pressure differential creating device includes a variable oiifice to selectively adjust the difference in pressure between the first and second pressure regions of the third pressure differential creating device.

27. The apparatus of claim 25, further including a fourth pressure differential creating device arranged in parallel with the first pressure differential creating device and having a first pressure region, and a second pressure region with a pressure lower than the first pressure region of the fourth pressure differential creating device.

28. The apparatus of claim 27, further comprising:

a first selection valve that, when open, permits working fluid to flow through the first and second pressure differential creating devices; and a second selection valve that, when open, permits working fluid to flow through the third and fourth pressure differential creating devices.

29. The apparatus of claim 6, further comprising a working fluid evacuation element, the first and second working fluid chambers draining to the working fluid evacuation element.

30. The apparatus of claim 29, wherein the working fluid evacuation element is a jet pump, the jet pump having an inlet, an outlet, and a low-pressure throat;

wherein working fluid from the first pressure region of the first pressure differential creating device flows into the inlet of the jet pump; and wherein the first and second working fluid chambers drain into the low-pressure throat of the jet pump.

31. The apparatus of claim 6, wherein the first pressure differential creating device is a venturi having an inlet, a low-pressure throat, and an outlet;

wherein working fluid enters the inlet of the venturi, and injection fluid from the first and second injection chambers enters the low-pressure throat of the venturi.

32. The apparatus of claim 6, further including at least one injection fluid storage container selectively connected to the first and second injection fluid chambers.

33. The apparatus of claim 32, further comprising:

a first passage selectively connecting the first and second injection fluid chambers and the second pressure region of the first pressure differential creating device;

and an injection fluid return passage selectively connecting the first passage to the at least one storage container.

34. The apparatus of claim 6, further comprising:

a flush passage that selectively carries working fluid to the first and second injection fluid chambers during a cleaning operation.

35. The apparatus of claim 6, further comprising a pressure reducing valve disposed in the first pressure region of the first pressure differential creating device.

36. The apparatus of claim 35, wherein the pressure reducing valve is a check valve.

37. A method of combining an injection fluid into a working fluid, comprising:

providing first and second vessels, each vessel divided by a flexible element into a working fluid chamber and an injection fluid chamber;

selectively and alternately filling the injection fluid chambers of the first and second vessels with working fluid;

directing a first part of the working fluid to flow through a first pressure differential creating device;

directing a second part of the working fluid to selectively and alternately flow through a second pressure differential creating device and into and out of the working fluid chambers of the second and first vessels;

selectively and alternately emptying the injection fluid contained in tihe injection fluid chambers into a low-pressure region created by the first pressure differential creating device;

automatically and alternately refilling the injection fluid chambers with injection fluid while ensuring a constant flow of working fluid through the first pressure differential creating device;

whereby the alternate filling, emptying and refilling of the working and injection fluid chambers of the first and second vessels provides a constant and continuous proportioning of injection fluid into the working fluid, the proportioning being independent of working fluid pressure and flow rate.

* * * * *